United States Patent [19]

Johnson, deceased et al.

[11] Patent Number: 4,986,370

[45] Date of Patent: Jan. 22, 1991

[54] PNEUMATIC HAMMER LIFT

[76] Inventors: John Johnson, deceased, late of Greenville, S.C.; by Henryka Johnson, heiress, 350 Fairforest Wax, Apt. #2308, Greenville, S.C. 29607

[21] Appl. No.: 299,317

[22] Filed: Jan. 19, 1989

[51] Int. Cl.[5] ..... E21C 9/00

[52] U.S. Cl. ..... 173/31; 176/32; 176/141

[58] Field of Search ..... 173/31–34, 173/36, 141, 152

[56] References Cited

U.S. PATENT DOCUMENTS

| | | | |
|---|---|---|---|
| 2,165,904 | 7/1939 | Osgood | 173/31 |
| 2,643,088 | 6/1953 | Hornack | 173/152 |
| 2,889,723 | 6/1959 | Morrell | 173/141 |
| 2,917,953 | 12/1959 | Badali | 173/152 X |
| 3,189,104 | 6/1965 | Jamer et al. | 173/31 X |
| 4,757,866 | 6/1988 | Szoke | 173/141 X |

*Primary Examiner*—Douglas D. Watts
*Assistant Examiner*—Willmon Fridie, Jr
*Attorney, Agent, or Firm*—Bailey & Hardaway

[57] ABSTRACT

An apparatus for lifting a pneumatic hammer from the hammer's work surface. A pneumatic lift attachment is provided having a support housing. Attached to the support housing is a lift plate, containing a guide hole and an adjustable chain, for securing a pneumatic hammer to the lift plate. Defined within the housing is an air cylinder containing a piston having a piston rod. The piston is responsive to air supplied to the air cylinder, which drives the piston and piston rod downward. Attached to the bottom of the piston rod is a foot. As the foot meets the ground's surface, the support housing is lifted, freeing the attached hammer from the work surface.

4 Claims, 2 Drawing Sheets

PNEUMATIC HAMMER LIFT

BACKGROUND OF THE INVENTION

This invention relates generally to pnuematic hammers and the like and more particularly to a lift attachment for a pneumatic hammer.

Frequently, during the use of a pneumatic hammer, the chisel bit will become wedged in the hammered surface. In such a situation, the pneumatic hammer has to be manually withdrawn and repositioned. Since a typical hammer weighs 60–100 pounds, this is a taxing chore.

Additionally, the hammer weight prevents one worker from being able to operate a hammer for extended periods of time. As a result, a team of operators is needed to provide continuous hammer operation. This is inefficient and, as a consequence, greatly increases overall construction costs.

SUMMARY OF THE INVENTION

It is thus an object of the present invention is to provide an apparatus which eliminates the need to manually remove and lift a stuck pnuematic hammer.

It is a further and more particular object to provide an apparatus which loosens and lifts a stuck pnuematic hammer using the pnuematic power of the hammer. It is also an object of the invention to provide an apparatus which eliminates the physical strain of repetitive manual lifting and repositioning of a pneumatic hammer.

These as well as other objects are accomplished by providing an apparatus for lifting a pnuematic hammer from the hammer's work surface. The pnuematic hammer lift attachment generally comprises a support housing. Appended to the support housing is a lift plate, containing a guide and an adjustable chain, for securing a pnuematic hammer. Defined within the housing is an air cylinder containing a piston having a piston rod. The piston is responsive to air supplied to the air cylinder, which drives the piston downward. As the piston is driven downward, so is a foot attached to the piston rod. As the foot meets the ground surface, it provides a firm base of support allowing the support housing to be lifted, raising the bulky hammer from the work surface.

DETAILED DESCRIPTION

In accordance with the invention, it has been found that an attachment may be provided for a pneumatic jack hammer which significantly reduces the amount of effort required to operate such a hammer.

Figure 1:
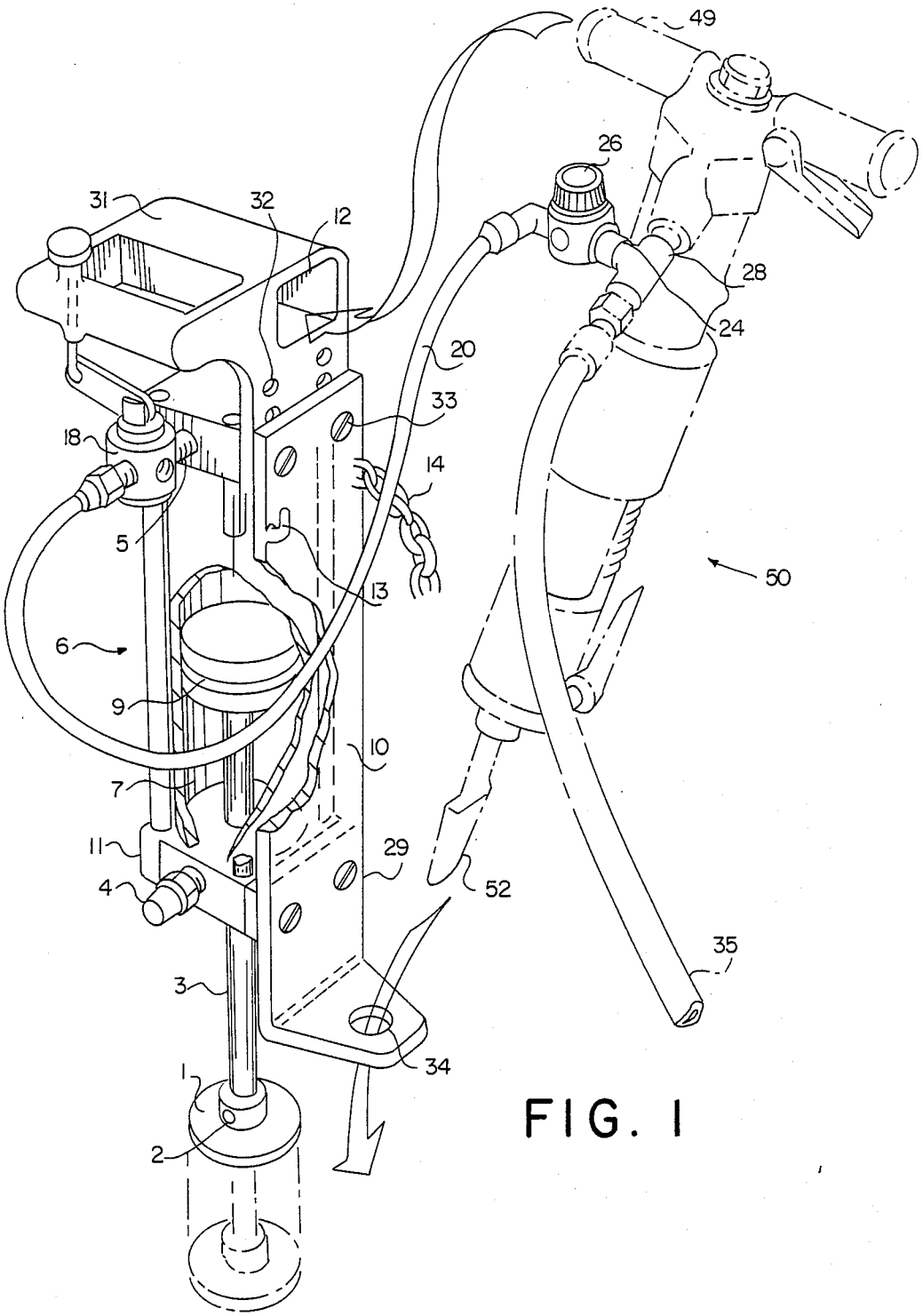
FIG. 1 is a perspective view, partially in section, of the preferred embodiment of the invention and further illustrating in phantom an unattached pnuematic hammer and the method of attachment.
Figure 2:
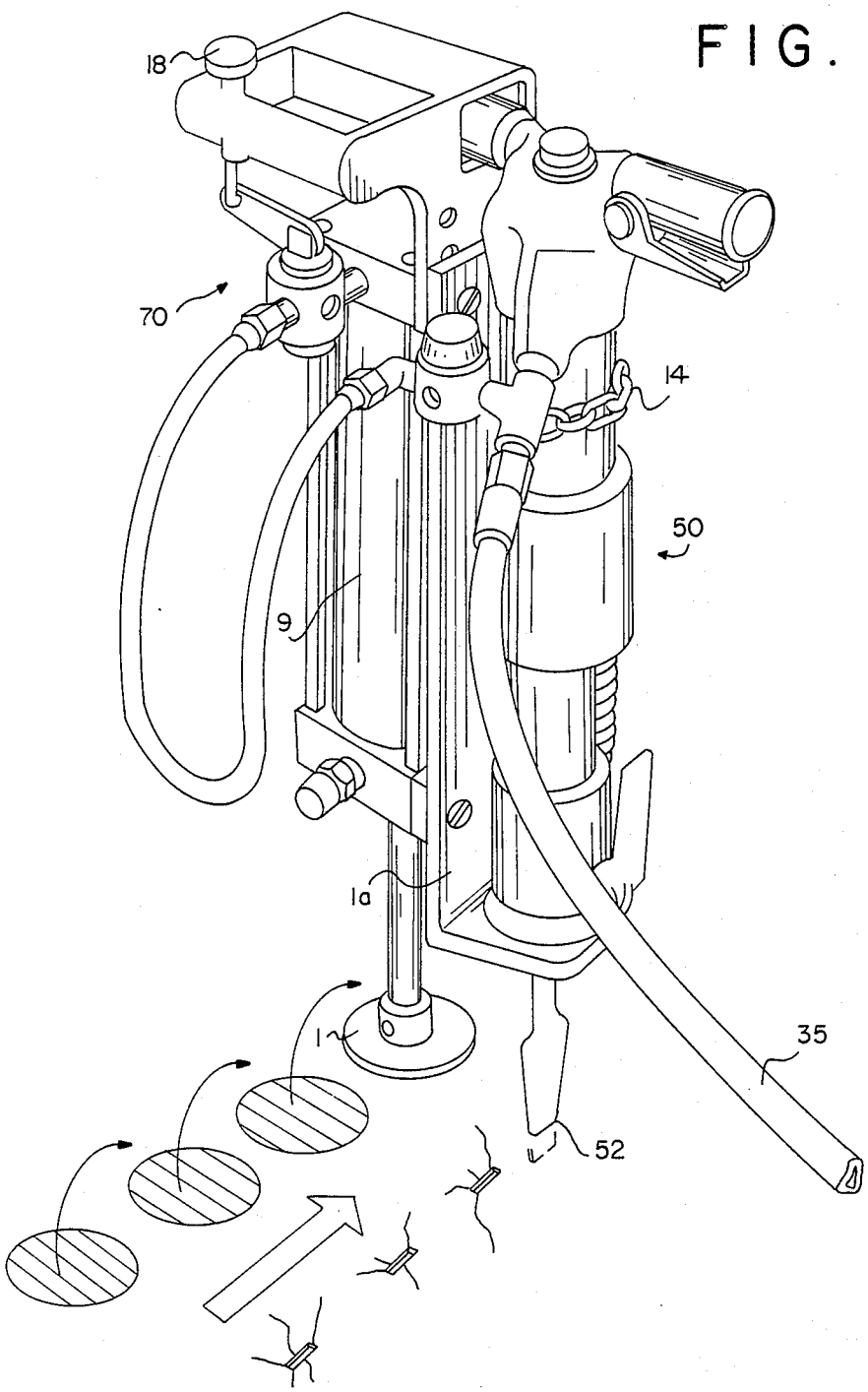
FIG. 2 is a perspective view of the pnuematic hammer lift attachment with the pnuematic hammer attached and further illustrating the operation of the apparatus.

FIG. 1 illustrate the preferred embodiment of a pnuematic lift attachment for lifting and freeing a pneumatic jack hammer. The lift attachment 6 is comprised of a housing 11 which defines an air cylinder 7. An "L"-shaped steel lift plate 10 is attached to the housing by bolts 29. Lift plate 10 provides a guide hole 34 through which the jack hammer chisel 52 is inserted. As illustrated in FIG. 2, the hammer 50 is secured to the lift plate 10 by an adjustable metal chain 14 which can accomodate a variety of different sized hammers via hook 13 (FIG. 1), provided on the lift plate 10.

A holding slot 12 is defined by holding head 31 in which the non-trigger handle 49 of the jack hammer is inserted. The height of the holding head 31 is controlled by adjustable bolts 33, allowing a variety of different sized hammers to be used.

An air hose 35 provides communication between the hammer and an air supply. This same air supply serves to power the pneumatic lift attachment via a tee coupling 28. The coupling 28 is coupled at 24 to an air pressure adjusting valve 26. Adjusting valve 26 is further coupled by flexible hose 20 to three-way valve 18. Coupling 5 provides communication between air cylinder 7 and three-way valve 18.

As the three-way valve 18 allows pressurized air to enter air cylinder 7, the piston 9 is forced downward, venting air within the lower air cylinder through air port filter 4. As a position 9 is driven downward, so is attached piston rod 3. This motion forces the metal foot 1, attached to piston rod 3 by means of a locking pin 2, to strike the ground, firmly positioning the lift attachment. As further pressure is applied, the lift plate 10 and attached hammer 50 is lifted from the work surface.

When the air pressure is vented from the air chamber through the three way valve 18, the combined weight of the hammer 50 and lift attachment 6, drives the piston into the air chamber 7.

Simultaneously, fresh air is drawn through the air port with filter 4 into the chamber 7 below piston 9, until chisel 52 rests upon the surface of the ground.

It is thus seen that the invention as described provides a novel means to withdraw a pnuematic jack hammer which becomes embedded in the ground's surface. Furthermore, since the invention supplies vertical support for pnuematic hammer, a means is provided whereby a single operator can operate a pneumatic jack hammer for an extended period of time. As the above description is exemplary in nature, many variations thereof will become apparent to those of skill in the art. Such variations, however, are embodied within the spirit and scope of the invention as defined by the following appended claims:

It is claimed:

1. A pneumatic lift attachment for a pneumatic jack hammer for applying an upward force to said jack hammer, the pnuematic lift attachment comprising:

a housing, defining an air cylinder;

a piston, housed within said air cylinder;

a piston rod, attached to said piston;

a metal foot, attached to said piston rod;

a lift plate attached to said housing to support said jack hammer;

a three-way air valve coupled to said housing in communication with said air cylinder;

means defining a holding slot attached to said housing wherein a handle to said jack hammer be secured within said holding slot;

a tee coupling attached to said jack hammer;

an air pressure adjustment valve communicating with said tee coupling;

a hose which attaches said air pressure adjustment valve to said three-way air valve;

an air port, with filter, coupled to said housing;

wherein, said lifting attachment operates when said air cylinder admits air from three-way valve, forcing said piston rod to be displaced from housing, thereby simultaneously lifting said housing carrying said lift plate and said supported jack hammer away from said metal foot, thereafter, said three-way valve releases pressure from the cylinder allowing piston to reenter housing, lowering said housing carrying said lift plate and said jack hammer until said chisel is in contact with the ground.

2. The apparatus according to claim 1 wherein said lift plate is an "L" shaped, steel plate determining a guide hole for the insertion of a chisel of said jack hammer.

3. The apparatus according to claim 1 further including an adjustable metal chain for securing said jack hammer to said lift plate.

4. The apparatus according to claim 1 wherein said holding slot is adjustable to accommodate various sized jack hammers.

* * * * *